United States Patent [19]

Abbott

[11] 3,971,688

[45] July 27, 1976

[54] METHOD OF MAKING AN ELONGATE, TRANSVERSELY REINFORCED METAL SHEET

[75] Inventor: Richard Abbott, Dearborn Heights, Mich.

[73] Assignee: Fruehauf Corporation, Detroit, Mich.

[22] Filed: Dec. 20, 1974

[21] Appl. No.: 534,802

[52] U.S. Cl. ..... 156/295; 156/297; 156/310; 156/322; 156/327; 428/77; 428/380; 428/458

[51] Int. Cl.[2] ..... B32B 15/04; B32B 15/08; B32B 31/12; B32B 7/12

[58] Field of Search ..... 428/77, 380, 458, 457; 156/322, 291, 295, 297, 327, 310; 228/251

[56] References Cited

UNITED STATES PATENTS

| | | | |
|---|---|---|---|
| 2,471,500 | 5/1949 | Stewart et al. | 428/458 X |
| 2,510,727 | 6/1950 | Sussenbach | 428/458 X |
| 2,545,370 | 3/1951 | Mittelmann | 156/322 X |
| 2,847,340 | 8/1958 | Joosten | 156/291 |
| 3,393,174 | 7/1968 | Potter et al. | 428/458 X |
| 3,616,009 | 10/1971 | Rost et al. | 156/310 X |
| R27,748 | 9/1973 | Peerman et al. | 428/458 X |

*Primary Examiner*—Philip Dier
*Attorney, Agent, or Firm*—John P. Snyder

[57] ABSTRACT

An automated process of making reinforced roof and wall sheets for trucks and trailers employs step-by-step advancement of the sheet stock and lateral infeed of the structural reinforcing members. As the reinforcing members are sequentially fed into registry with the sheet stock, two kinds of adhesive are applied to them, one being a hot melt adhesive and the other being a catalyzed room temperature curing adhesive. The hot melt adhesive sets to provide an initial bonding which allows normal handling while the room temperature curing adhesive cures in the joint ultimately to augment the hot melt and provide a high strength joint.

6 Claims, 3 Drawing Figures

METHOD OF MAKING AN ELONGATE, TRANSVERSELY REINFORCED METAL SHEET

BACKGROUND OF THE INVENTION

In constructing truck and trailer bodies it is conventional to join metal structural members to metal sheet members by means of heat-curable adhesives. For example, the roof sheet of a trailer body may be joined to the roof bow members by fixing the roof bows in proper relation to each other, applying a catalyzed heat-curable adhesive to the bonding surfaces of the roof bows, placing the roof sheet in proper position on the roof bows and clamping the whole assembly together, and then subjecting the assembly to a heat-curing cycle as for example to a temperature of 180°F for twenty minutes.

The bonding strength of such heat-curable adhesives is sufficient to provide the necessary structural integrity of the assembly but the technique is obviously time consuming due to the heat cure cycle and requires a rather complex clamping system to hold the parts in place until cure is effected.

The use of hot melt adhesives has been considered because their use would eliminate the heat cure cycle but they present other problems, notably the requirement of heating the roof bows in order to prevent premature cooling and setting of the adhesive, and insufficient bonding strength to assure an assembly of the requisite structural integrity. These problems can be solved by the use of a heat-insulating layer of glass fiber scrim cloth placed upon the roof bows as disclosed in commonly assigned application, docket 25-BB, filed concurrently herewith. However, the use of the scrim cloth represents a cost factor which it would be desirable to eliminate.

BRIEF SUMMARY OF THE INVENTION

Accordingly, the present invention is directed to a system in which the use of the scrim cloth as disclosed in the aforesaid application is eliminated while also eliminating the use of heat-curable adhesives and the resultant heat cure cycle required therefor.

In essence, the present invention relates to the use of a hot melt adhesive in conjunction with a room temperature curing adhesive, the former attaining a substantially immediate or initial moderate bonding strength which allows an automated process to be realized while the latter provides an increased structural integrity over a period of time at room temperature curing conditions as attains the requisite overall strength for the finished product.

The method according to this invention involves the step-by-step advancing of metal sheet stock in conjunction with the successive, lateral infeeding of metal structural members in which, incidental to the lateral infeeding, both a hot melt adhesive and a catalyzed room temperature curing adhesive are applied to the structural members. When a structural member is positioned in spaced transverse alignment with the sheet stock the two are pressed together to flatten and spread the adhesives therebetween, the hot melt adhesive setting to provide an initial, moderate strength bonding sufficient to allow handling of the integrated assembly and the other adhesive curing slowly over a subsequent period of time to develop the requisite overall bonding strength.

The two adhesives are applied side-by-side as the structural members are fed longitudinally in direction lateral to the step-by-step movement of the sheet stock so that whereas there will be a minimal intermingling of the two adhesives as the parts are clamped together, they nevertheless will spread evenly to cover continuously over and bond together the surfaces of the parts. Preferably the structural members are preheated in order to assure that no premature setting of the hot melt adhesive takes place.

BRIEF DESCRIPTION OF THE DRAWING FIGURES

DETAILED DESCRIPTION OF THE INVENTION

Figure 1:
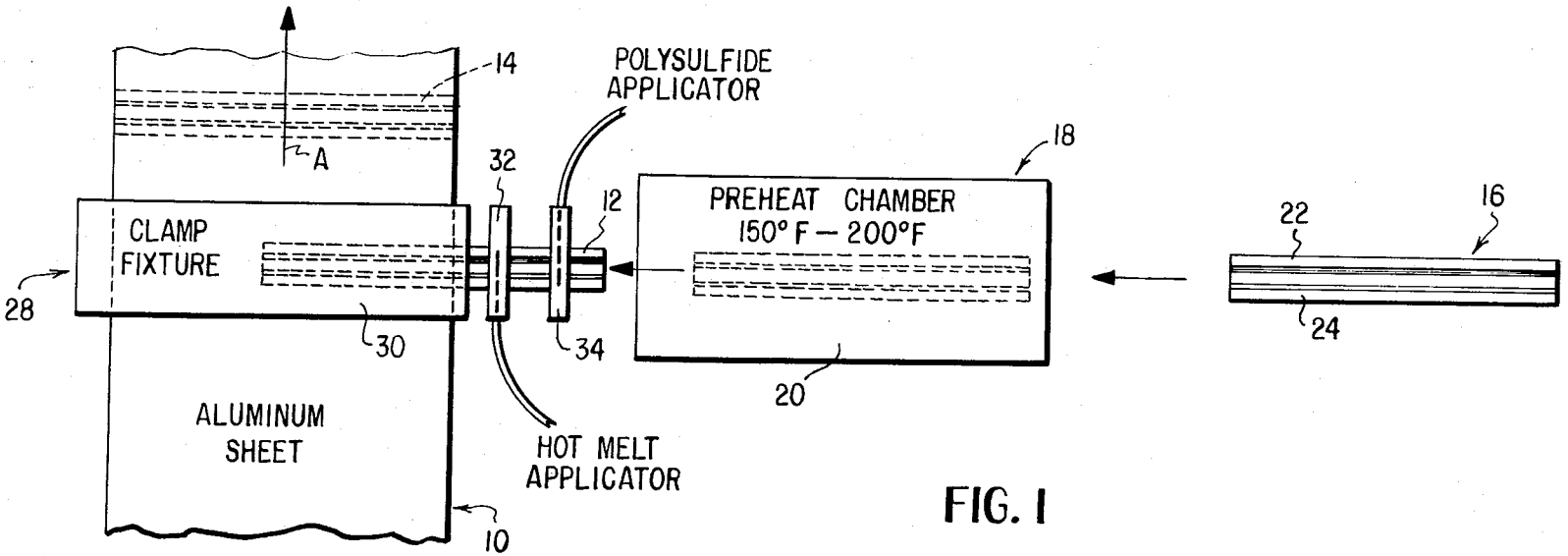
FIG. 1 is a plan view illustrating the process according to this invention.

As shown in FIG. 1, a length of aluminum sheet 10 is advanced step-by-step in the direction of the arrow A, each step being of a selected length to allow transverse structural elements to be joined to the underside of the sheet at spaced intervals therealong. A structural element in the process of being positioned is indicated at 12 in FIG. 1 and a further element 14 is shown already secured to the sheet 10.

A supply 16 of structural elements is fed one-by-one to a preheating station 18 which may consist simply of an oven or like heating chamber 20 wherein the structural elements reside for a time sufficient to attain the ambient temperature in the oven, which is in the order of 150°–200°F. The structural members may take a variety of shapes but those specifically shown are of trough-like configuration having relatively wide opposite side flanges 22 and 24 which present upwardly facing bonding surfaces. The structural members are translated longitudinally from the heating station along a path lying below and directed transversely to the path of the sheet 10, ultimately to be received in the recess of the vertically reciprocable, lower member 26 of the clamping assembly 28. The clamping assembly defines the bonding station and includes the upper, fixed clamping member 30 which overlies the sheet 10.

As the structural member is being fed to the lower clamping member 26, each of the bonding surfaces defined by the flanges 22 and 24 receives adhesive from the two applicators 32 and 34. The applicator 32 applies a continuous bead or a series of dots or dashes of a hot melt adhesive line on each bonding surface, as indicated at 36 and 38 in FIG. 2, whereas the applicator 34 similarly applies adhesive lines 40 and 42 which consist of a catalyzed, room temperature curing adhesive. Thus, each bonding surface receives, side-by-side one line of hot melt adhesive and one line of room temperature curing adhesive. As is conventional, the hot melt adhesive is heated to become fluid and is applied in such state.

Figure 3:
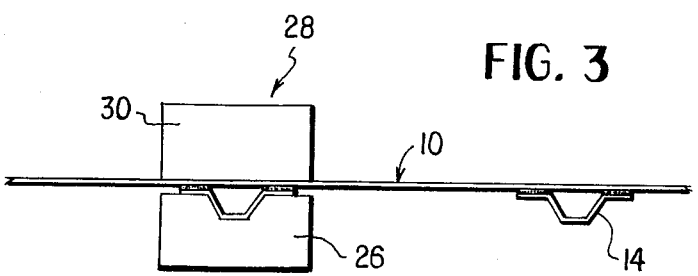
FIG. 3 is a view similar to FIG. 2 but showing the parts clamped together.
Figure 2:
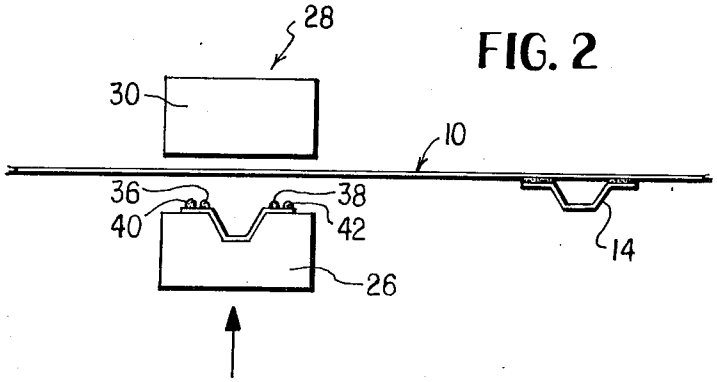
FIG. 2 is a side elevation showing the ascending clamp member carrying the structural element.

The structural member with adhesive applied reaches a position fully nested within the lower clamping member 26, at which time this member is moved upwardly as indicated by the arrow in FIG. 2 until the two clamping members 26 and 30 firmly sandwich the sheet and structural member therebetween, as shown in FIG. 3. Each pair of adhesive lines on each bonding surface are spread out and flattened to define discrete areas of the two different kinds of adhesive which cumulatively cover all or substantially all of their corresponding bonding surfaces. Preferably, the upper clamping member 30 is cooled as by internal water flow rapidly to cool and set the hot melt adhesive so that within a period of about 5 seconds the lower clamping member 26 may be retracted to receive the next structural member while the sheet 10 is advanced to a new position relative to the bonding station.

The two adhesives do not mix or intermingle to any appreciable extent even though there is a direct interface between them. In fact, the side-by-side disposition of the two adhesives provides a natural barrier, each for the other, which assures an even spreading and flow of the adhesives throughout discrete areas which cumulatively cover the bonding surface. The flow rate of adhesive laid down should be sufficient to effect complete coverage of the bonding surfaces without an undue amount of adhesive flowing out from between the opposed surfaces of the sheet 10 and structural member.

Various types of hot melt adhesives may be employed. They should be based on thermoplastic elastomers formulated to provide relatively long open times of fifteen seconds minimum and with tackifiers added to provide good pressure sensitive properties. These adhesives are applied at a temperature of 300°–400°F and typically will be polybutadiene elastomers, polyisopropene-styrene copolymer elastomers, polyester elastomers and the like.

The catalyzed, room temperature curing adhesives should provide low temperature flexibility and strength, high peel strength (minimum of 30 ppi), and high lap shear strength (minimum of 150 psi); they must cure at low temperatures (under 100°F) and should be more than 80%, preferably 100% solids. They may be one-part or two-part adhesives such as thiokol base (polysulfide), silicone, modified epoxy and urethane types.

The initial bonding provided by the hot melt adhesive provides sufficient initial strength for handling the product whereas the room temperature curing adhesive develops its full strength over a period of time depending upon temperature and humidity to which the assembly is subjected.

What is claimed herein is:

1. The method of making a reinforced metal sheet which comprises the steps of:

a. separately applying a heated, fluid hot melt adhesive and a catalyzed, room temperature curing adhesive in localized side-by-side relation along and within the confines of a bonding surface of a structural member;

b. positioning the structural member of step (*a*) and a metal sheet in spaced registry; and while the hot melt adhesive is fluid, c. pressing the structural member and the metal sheet together with force sufficient to spread both adhesives out over respectively discrete surface areas cumulatively covering substantially the entirety of said bonding surface and for a time sufficient to allow said hot melt adhesive to set and bond the sheet and structural member together.

2. The method of making an elongate, transversely reinforced metal sheet, which comprises the steps of:

a. advancing an elongate metal sheet through a selected distance and stopping it at a bonding station;

b. longitudinally shifting an elongate structural member into spaced, transverse registry with said metal sheet at said station and in a direction transverse to the path along which said metal sheet is advanced;

c. during step (*b*), dispensing a hot melt adhesive and a catalyzed room temperature curing adhesive in side-by-side relation longitudinally along a bonding surface of the structural member; and while the hot melt adhesive is fluid, d. pressing the structural member and the metal sheet together with force sufficient to spread both adhesives out over respectively discrete surface areas cumulatively covering substantially the entirety of said bonding surface and for a time sufficient to allow said hot melt adhesive to set and bond the sheet and structural member together; and e. repeating steps (*a*) – (*d*) to adhere further structural members to said sheet.

3. The method according to claim 2 including the steps of preheating each structural member prior to step (*b*).

4. The method according to claim 3 including the step of cooling that region of the metal sheet opposite the area contacted by the structural member in step (*d*).

5. The method according to claim 2 including the step of cooling that region of the metal sheet opposite the area contacted by the structural member in step (*d*).

6. The method according to claim 1 wherein said room temperature curing adhesive is a polysulfide.

* * * * *